United States Patent [19]

Young et al.

[11] 4,202,517

[45] May 13, 1980

[54] FLUIDIC INTERFACE MEANS

[75] Inventors: Robert W. Young, Montgomery Township, Montgomery County; Leonard D. Dansbury, Levittown, both of Pa.

[73] Assignee: The United States of America as represented by the Secretary of the Navy, Washington, D.C.

[21] Appl. No.: 817,884

[22] Filed: Jul. 20, 1977

[51] Int. Cl.[2] ..... F15C 1/12; F41G 7/00; F42B 15/02

[52] U.S. Cl. ..... 244/3.22; 137/805

[58] Field of Search ..... 137/805, 807, 819, 829, 137/836; 244/76 J, 78, 3.22

[56] References Cited

U.S. PATENT DOCUMENTS

| | | | |
|---|---|---|---|
| 3,610,267 | 10/1971 | Warren | 244/3.22 |
| 3,614,027 | 10/1971 | Lewis | 244/3.22 |
| 3,645,475 | 2/1972 | Stripling | 244/3.22 |
| 3,706,263 | 12/1972 | Johnson | 137/805 X |
| 3,720,217 | 3/1973 | Matthews | 137/805 |
| 3,802,190 | 4/1974 | Kaufmann | 244/3.22 X |
| 3,817,480 | 6/1974 | Ringwall | 137/805 X |
| 3,986,856 | 10/1976 | Fournier | 137/805 X |
| 4,019,697 | 4/1977 | Tippetts | 137/805 X |

*Primary Examiner*—William R. Cline

*Attorney, Agent, or Firm*—R. S. Sciascia; L. I. Shrago; C. E. Vautrain, Jr.

[57] ABSTRACT

A means for interfacing between low pressure, low flow fluidic circuits and the high pressure, high flow input requirements of fluidic digital thrusters to control the roll, pitch or yaw rate of missiles is provided. Input pressures from the fluidic circuitry cause a fluidic digital amplifier to go to one of its two stable states. The output from the digital amplifier operates one piston in the interface means, causing it to close off a digital thruster control port. The same output is ported to the opposite side of the other interface means piston, causing it to unblock the other digital thruster control port. Blocking of the first control port causes the digital thruster to switch to either a left or right output leg to initiate a corrective thrust. The pistons are interlocked so that only one piston can be extended to cover a given control port at any time.

2 Claims, 4 Drawing Figures

FLUIDIC INTERFACE MEANS

The present invention relates to interface devices and, more particularly, an interface device for providing a fluidic interface between low pressure low flow fluidic circuitry and high pressure high flow digital thrusters.

The effectiveness of homing tactical missiles is greatly compromised by severe roll rates induced by aerodynamic torques. The use of some form of roll damping or roll rate reduction is, therefore, necessary for the proper performance of these missiles. Generally, the roll rate must be damped to allow a sensor to lock on to a target and guide the missile to the target. Since highly accurate roll rate control systems are very sophisticated and, therefore, exxpensive, and since relatively large rates of up to 100 deg/sec can be tolerated by the guidance system, the availability of a simple and inexpensive roll control system is virtually mandatory. One such device consists of a momentum wheel or rolleron mounted in an aileron. The rolleron, however, has several disadvantages among which are its mechanical moving parts which wear out, the finite amount of time required to spin up the wheel, the mechanical vibrations caused by the spinning wheel, and its relatively high cost. One alternate approach to the problem is a jet-free stream interaction device wherein roll control is implemented with an all fluid system, which system would also provide the roll control at launch not achievable with the momentum wheel. A suitable fluidic system is one based on a laminar angular rate sensor having a fluidic bi-stable switch as the actuating or thrusting element. Such fluidic switches ordinarily require a relatively high differential pressure and/or flow to change their output state and, therefore, the thrusting direction. Thus, in order to mate the low power signal available from the fluidic circuitry to the high power signal required by the fluidic thruster, a power interface device is required. The purpose of such a device is to take the low signal levels available from the fluidic circuitry and to amplify this signal in order to control the output of stacked fluidic thrusters. The present invention provides an interface unit which is suitable in terms of weight, cost, and volume to mate these two elements in the desired application.

Accordingly, it is an object of the present invention to provide and interface device of very small size which is adapted to accept as its input low power signal levels and to provide means of controlling high output power signals.

Another object of this invention is to provide an interface device having very small size, light weight and low cost and adapted to accept low initial flight signal levels and to be suitable for use in controlling individual ailerons or thrusters in small craft such as tactical missiles.

A further object of this invention is to provide an interface device for mating the high pressure, high flow input requirements of fluidic digital thrusters and the low pressure and flow from fluidic circuits.

Other objects, advantages and novel features of the invention will become apparent when considered in conjunction with the accompanying drawings in which like numerals represent like parts throughout and wherein.

The present invention, in general, concerns a device for controlling the opening and closing of the proper one of two control ports in such a manner that both ports cannot be actuated at the same time and, thereby, controlling the output of the thrusters by means of controlling the Coanda effect.

Air enters the port below one of two pistons in the device, forcing this piston upward against an adjacent control port and thereby closing off this control port. The same air is conducted to the opposite side of the other piston so as to force that piston downward and maintain its adjacent control port open. A thruster power jet attaches to the side on which the control port is blocked so that when one piston is up and blocking the other piston must be disabled, because of the interlocking flow passages of the device, to insure proper control.

Figure 1:
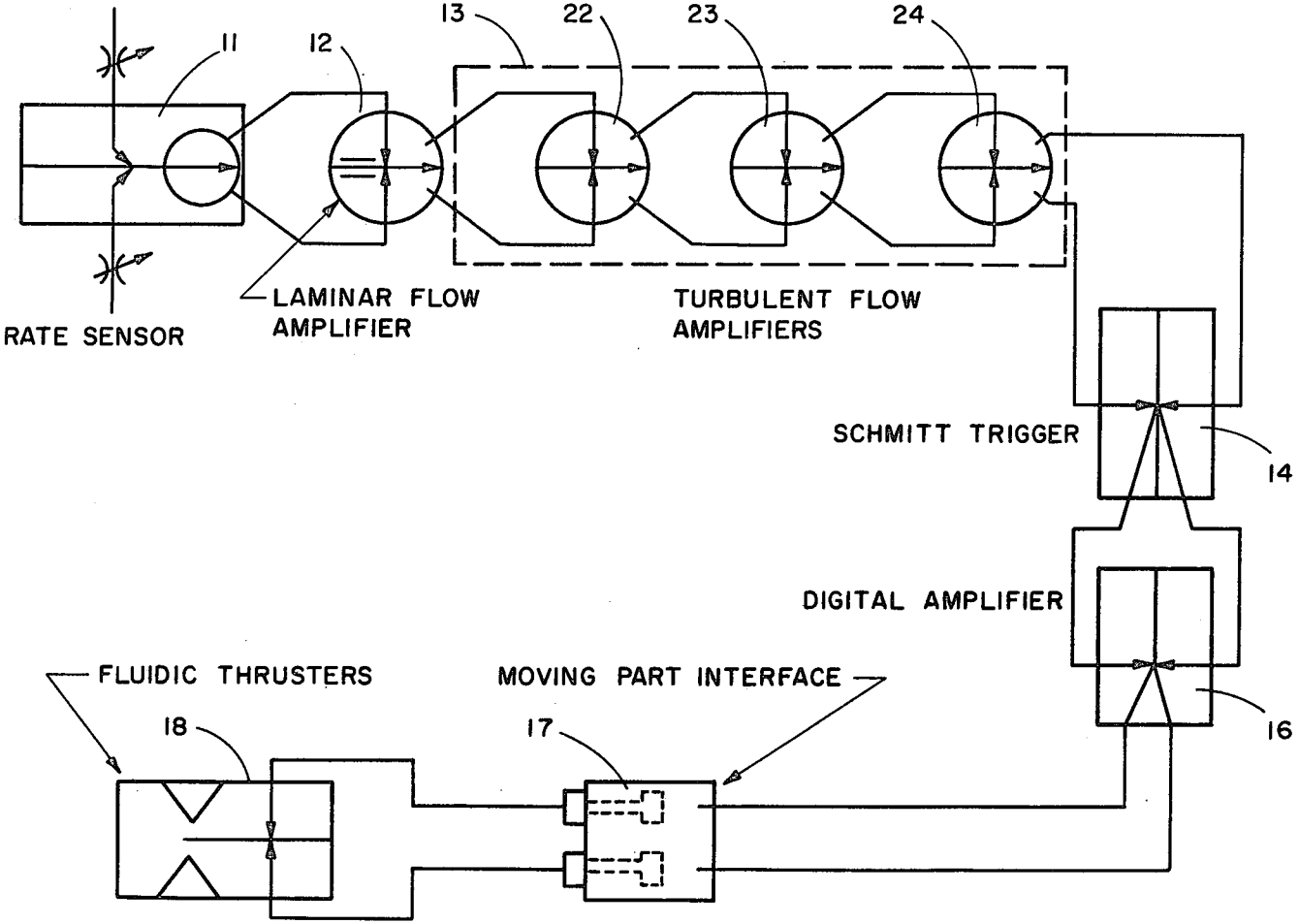
FIG. 1 is a schematic drawing of a fluidic implementation of a low rate damping control circuit which includes the interface device of the present invention.
Figure 2:
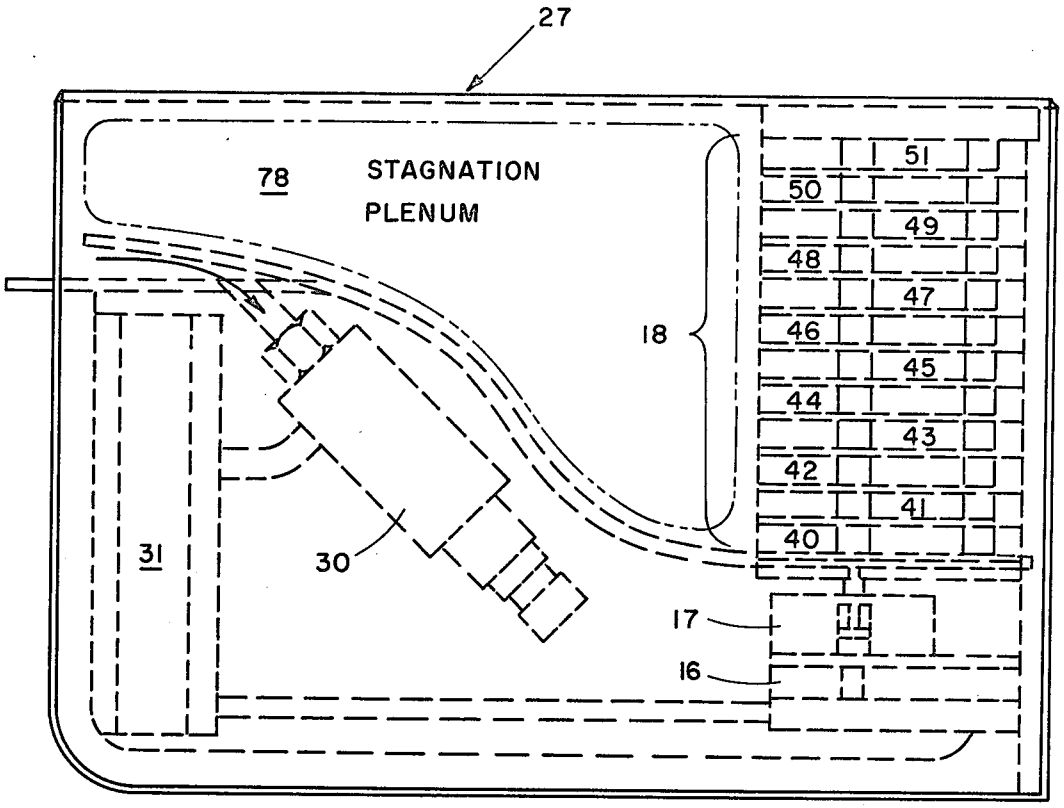
FIG. 2 is a plan view with side plate removed of the roll-rate damping components of the circuit of FIG. 1.

Referring to the drawings, FIG. 1 is a schematic representation of the fluid implementation of a roll rate damping system using the interface device of the present invention which includes a rate sensor 11, a laminar flow amplifier 12, a laminar to turbulent transition gain block 13, a Schmitt Trigger 14, a digital amplifier 16, and an interface device 17 for converting low input signals into control signals for a series of fluidic thrusters 18. Transition gain block 13 includes three turbulent flow amplifiers 22–24. Rate sensor 11 generates a differential signal proportional to angular rate which is amplified and serves as the input to gain block 13. Ram air is captured by a scoop, not shown, and provides the power for the thrusters and sensing device. Since the velocity of a missile varies widely, ram air pressure can vary from 0 psig launch to as much as 40 psig. Accordingly, a pressure regulator, shown in FIG. 2, is provided to supply a constant pressure input to rate sensor 11 and Schmitt Trigger 14. The system becomes active when the ram air pressure reaches 4.0 psig, within about 0.5 seconds in a specific application. Thrusters 18 use the unregulated ram air.

FIG. 2 shows a roll-rate damping control package 27, which includes a pressure regulator 30, a block presentation 31 of the fluidic logic shown in FIG. 1 to and including Schmitt Trigger 14, fluidic digital amplifier 10, moving part interface 17, and fluidic thrusters 18 which are interconnected and numbered 40–51, all of these components being contained within the system package for each aileron, other device to be controlled, or to act as thrusters.

Figure 3:
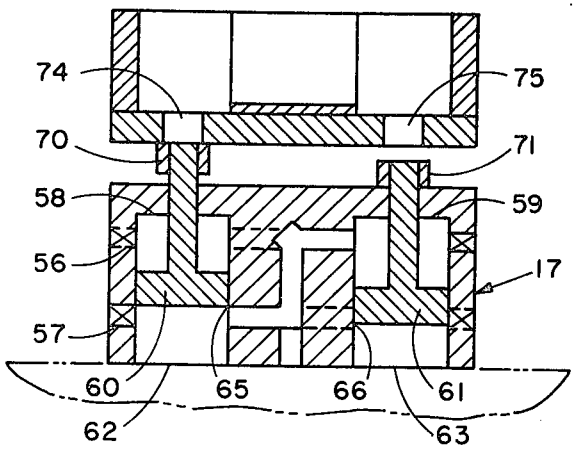
FIG. 3 is a side elevation in section of the interface device of FIG. 1 illustrating the interlocking action of the pistons therein.
Figure 4:
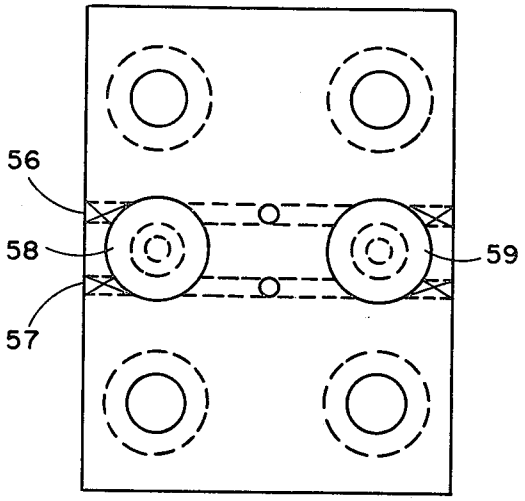
FIG. 4 is a plan view of the interface device shown in FIG. 3.

FIGS. 3 and 4 show interface device 17 in section and plan views, respectively, with the sectional view of FIG. 3 illustrating the interlocking action provided by a pair of passages 56 and 57 which admit air into piston chambers 58 and 59 for actuating pistons 60 and 61, respectively. Input pressures to the pistons come from fluidic digital amplifier 16 through chamber openings 62 and 63, respectively. Interface device 17 preferably has a stainless steel body and nylon pistons. Piston 60 is shown in the up or actuated position while piston 61 is shown in the down or off position. In the actuated position, the full piston surface is aligned with the top of passage 57 as indicated at 65. In the down position, the full piston surface is positioned within the span of passage 56 as indicated at 66. Piston travel is limited by respective caps 70 and 71 which enlarge the base of the pistons in this use to effectively cover respective ports 74 and 75 in the device to be controlled. Passages 56 and 57 are normally closed to the exterior as indicated and interiorly connect the opposite ends of piston chambers 58 and 59 so that air pressure in either passage will be applied unequally against opposed surfaces of the pistons. The largest piston surface exposed to digital amplifier 16 thus is that of the piston desired to be actuated, i.e. piston 60 in FIG. 3.

In operation in a homing tactical missile, ram air is driven in through the scoop, and distributed in a stagnation plenum 78 directly to thrusters 40–51. The inlet to each thruster is open to the plenum, thereby exposing these elements to an inlet pressure that can vary from 0 to 40 psig according to the velocity profile of the missile. Pressure regulator 30 is installed to control the pressure to the fluidic circuit which requires an accurate input pressure. Therefore, the complete system can function properly only over a stagnation pressure range of from about 4 to 40 psig. Regulator 30 receives ram air from the stagnation plenum and applies it at substantially 2 psi to rate sensor 11 and 3 psi to Schmitt Trigger 14. The regulator output is set at 3 psig directly to the Schmitt Trigger and through an adjustable orifice where the pressure is reduced to 2 psig to the rate sensor. The minimum inlet pressure at which regulator 30 in this case is effective is 4 psig. Regulator 30 and moving part interface 17 are the only non-flueric, i.e. moving part, elements in the control package. Since the output flow available from laminar flow amplifier 12 is very low, this amplifier could not drive Schmitt Trigger 14 directly without a substantial loss in pressure gain. Therefore, a laminar amplifier and a threestage turbulent gain block 13 have been added to increase the output from the rate sensor.

The output pressure of the Schmitt Trigger exceeds the pressure needed to thrusters 18 but does not have enough output flow, therefore requiring a means of interfacing these components but without involving large amounts of flow into the thruster control ports. The method shown herein of accomplishing this interface is to control the suction pressure, i.e. the Coanda effect of the power jet issuing past control ports 74 and 75. When these control ports are open, the suction pressure is bled off to ambient. However, when one control port, such as 74, is blocked a suction pressure equal to the required switching pressure is generated in this control port and the power jet attaches to this side of the thrusters. By controlling the opening or closing of the proper thruster control port by means of interface device 17 through operation of fluidic digital amplifier 16, in effect the thrusters are made to generate their own control flow. Because of the unique design of the interface device, the input pressures to pistons 60 and 61 coming from fluidic bi-stable element 35 assure that both pistons cannot be actuated at the same time. the pistons are designed with a 4 to 1 area ratio to insure that the suction pressure on the top of the small piston, i.e. across caps 70 and 71 which is generated by the Coanda effect in the thrusters, can be easily overcome by the positive pressure at openings 62 and 63 which comes from the digital amplifier. Therefore, the low power signal from the bi-stable amplifier is received at the proper input port 62 or 63. This input signal causes one piston to extend and the other to retract. The extending piston causes the proper control port 74 or 75 to be closed. By closing this port, a suction pressure is generated by the Coanda effect of the power jet in the thrusters, thereby controlling the power jet so that it will exit out of the desired output nozzle of the thruster.

What is claimed is:

1. An interface device having dual pistons for providing a fluidic interface between low flow fluidic circuitry and high pressure high flow fluidic thrusters having two alternately actuated control ports and operated by ram air such as in homing tactical missiles comprising:

a thruster control system including a scoop for admitting ram air into said system and a stagnation plenum for distributing ram air to said fluidic thrusters;

low flow fluidic circuitry in said thruster control system including a rate sensor;

a fluidic digital amplifier interposed between said fluidic circuitry and said interface device and having alternate ports for directing low pressure flow to said interface device pistons.

said thrusters requiring a differential pressure and/or flow to change their thrusting direction that substantially exceeds the low flow output of said fluidic circuitry;

a pressure regulator in said thruster control system positioned to receive ram air and adapted to provide a constant low pressure flow input to said fluidic circuitry, said interface device including a block having a piston shaft disposed opposite each of said control ports and respective ports of said digital amplifier, the ends of said piston shafts blocking or exposing the appropriate one of said control ports thereby controlling the suction pressure at said ports so that said thrusters are made to generate their own flow control from ram air on the side having the blocked port, said pistons having heads whose outer and inner surfaces are exposed oppositely to the flow from said digital amplifier ports generated by said fluidic circuitry so that when one piston shaft blocks its respective control port the other piston is driven oppositely to expose the other of said control ports, said block having passages communicating between the interior of one piston chamber and the exterior of the other piston chamber to effect reciprocal motion of said pistons and assure interlocking operation thereof, said fluidic circuitry including means for increasing the output of said rate sensor, and said interface device causing said thrusters to provide a desired corrective power jet for control of the roll, pitch and yaw rates of said missile.

2. The interface device as defined in claim 1 wherein said outer and inner piston surfaces have area ratios of substantially 4 to 1 to assure reciprocal piston operation;

the low pressure signal from said digital amplifier received at the respective one of said chamber openings constituting an input signal which causes one of said pistons to extend toward said thrusters and the other of said pistons to retract toward said digital amplifier.

* * * * *